US009199247B2

(12) United States Patent
Ellis et al.

(10) Patent No.: US 9,199,247 B2
(45) Date of Patent: Dec. 1, 2015

(54) MAGNETIC SEPARATION RACK

(75) Inventors: Darren Ellis, Lommedalen (NO); Tine Borgen Hildisch, Oslo (NO); Jeremy Mundy, Highworth (GB); Erlend Ragnhildstveit, Oslo (NO); Richard Johan Toften, Paradis (NO); Kornelija Zgonc, Carlsbad, CA (US)

(73) Assignee: Invitrogen Dynal AS (NO)

( * ) Notice: Subject to any disclaimer, the term of this patent is extended or adjusted under 35 U.S.C. 154(b) by 749 days.

(21) Appl. No.: 12/601,751

(22) PCT Filed: May 29, 2008

(86) PCT No.: PCT/EP2008/056645

§ 371 (c)(1),
(2), (4) Date: Jun. 25, 2010

(87) PCT Pub. No.: WO2008/145709

PCT Pub. Date: Dec. 4, 2008

(65) Prior Publication Data

US 2011/0031168 A1 Feb. 10, 2011

Related U.S. Application Data

(60) Provisional application No. 60/940,629, filed on May 29, 2007, provisional application No. 60/940,614, filed on May 29, 2007, provisional application No. 61/014,624, filed on Dec. 18, 2007, provisional application No. 61/014,627, filed on Dec. 18, 2007.

(30) Foreign Application Priority Data

| | | |
|---|---|---|
| May 29, 2007 | (GB) | 0710188.4 |
| May 29, 2007 | (GB) | 0710189.2 |
| Dec. 14, 2007 | (GB) | 0724404.9 |
| Dec. 14, 2007 | (GB) | 0724426.2 |

(51) Int. Cl.
*B03C 1/02* (2006.01)
*B03C 1/28* (2006.01)

(52) U.S. Cl.
CPC ..... *B03C 1/288* (2013.01); *B03C 2201/18* (2013.01); *B03C 2201/26* (2013.01)

(58) Field of Classification Search
USPC ..... 209/223.1
IPC ..... B03C 1/14,1/22, 1/28, 1/26, 1/288, B03C 1/18, 2201/26, 2201/18; G01C 21/20; G01S 5/0009; G09B 29/005
See application file for complete search history.

(56) References Cited

U.S. PATENT DOCUMENTS

| | | | |
|---|---|---|---|
| 2,358,612 | A | 9/1944 | Acker et al. |
| 3,206,657 | A | 9/1965 | Moriya |

(Continued)

FOREIGN PATENT DOCUMENTS

| | | |
|---|---|---|
| DE | 10063984 | 6/2002 |
| EP | 0136126 | 4/1985 |

(Continued)

OTHER PUBLICATIONS

CN Application No. 200880017804.5, Office Action mailed Apr. 29, 2011.

(Continued)

*Primary Examiner* — Stefanos Karmis
*Assistant Examiner* — Michael E Butler
(74) *Attorney, Agent, or Firm* — Invitrogen Dynal AS

(57) ABSTRACT

The disclosure relates to a magnetic separation rack for isolating magnetically labeled particles from a non-magnetic medium comprising a body portion (1) and a foot portion (8). The body portion comprises an array of sample vessel retaining portions (2) and plurality of magnetizing portions (3). Each sample vessel retaining portion comprises at least one visible portion such that when a sample vessel is mounted in a sample vessel retaining portion at least one portion of the sample vessel is visible to a user. The magnetizing portions are arranged within the body portion (1) such that at least two magnetizing portions (3) are circumferentially spaced about each sample vessel retaining portion (2). The foot portion is pivotally coupled to the body portion such that the body portion is operatively tiltable with respect to the foot portion such that each sample vessel retaining portion may retain a sample vessel mounted therein in a tilted position with respect to the vertical. The disclosure further relates to a method of isolating magnetically labeled particles from a non-magnetic medium using the said magnetic separation rack.

17 Claims, 13 Drawing Sheets

(56) References Cited

U.S. PATENT DOCUMENTS

| | | | | |
|---|---|---|---|---|
| 3,674,198 | A | 7/1972 | Eberle | |
| 4,118,801 | A | 10/1978 | Kraft et al. | |
| 4,133,466 | A | 1/1979 | Rosen et al. | |
| 4,883,644 | A | 11/1989 | Perlman | |
| 4,895,650 | A | 1/1990 | Wang | |
| 4,896,560 | A | 1/1990 | Kato | |
| 5,036,989 | A * | 8/1991 | Carilli | 211/74 |
| 5,186,827 | A * | 2/1993 | Liberti et al. | 210/222 |
| 5,458,785 | A | 10/1995 | Howe et al. | |
| 5,465,078 | A | 11/1995 | Jones, Jr. | |
| 5,584,994 | A | 12/1996 | Hattori et al. | |
| 5,632,388 | A | 5/1997 | Morrison et al. | |
| 5,705,062 | A | 1/1998 | Knobel | |
| 5,714,063 | A | 2/1998 | Brunsting | |
| 5,827,478 | A * | 10/1998 | Carey et al. | 422/64 |
| 5,993,665 | A | 11/1999 | Terstappen et al. | |
| 6,133,037 | A | 10/2000 | Tajima | |
| 6,187,270 | B1 | 2/2001 | Schmitt et al. | |
| 6,193,892 | B1 * | 2/2001 | Krueger et al. | 210/695 |
| 6,231,814 | B1 | 5/2001 | Tajima | |
| 6,368,561 | B1 | 4/2002 | Rutishauser et al. | |
| 6,514,416 | B1 * | 2/2003 | Harradine et al. | 210/695 |
| 6,558,541 | B1 | 5/2003 | Morrison | |
| 6,586,193 | B2 * | 7/2003 | Yguerabide et al. | 506/3 |
| 6,743,365 | B1 | 6/2004 | Marlowe | |
| 6,752,967 | B2 * | 6/2004 | Farina et al. | 422/552 |
| 7,326,350 | B2 | 2/2008 | Mueller et al. | |
| 8,663,472 | B1 * | 3/2014 | Mallard et al. | 210/304 |
| 2001/0007312 | A1 | 7/2001 | Siddiqi | |
| 2002/0182751 | A1 * | 12/2002 | Herr et al. | 436/526 |
| 2003/0049841 | A1 * | 3/2003 | Short et al. | 435/449 |
| 2003/0134416 | A1 * | 7/2003 | Yamanishi et al. | 435/372 |
| 2004/0142384 | A1 | 7/2004 | Cohen et al. | |
| 2004/0142463 | A1 * | 7/2004 | Walker et al. | 435/325 |
| 2004/0265903 | A1 | 12/2004 | Mueller et al. | |
| 2005/0123445 | A1 * | 6/2005 | Blecka et al. | 422/64 |
| 2008/0190458 | A1 * | 8/2008 | Garcia Gros et al. | 134/25.1 |
| 2010/0264090 | A1 | 10/2010 | Ellis et al. | |
| 2010/0294706 | A1 * | 11/2010 | Simonson | 210/222 |
| 2011/0031168 | A1 | 2/2011 | Ellis et al. | |

FOREIGN PATENT DOCUMENTS

| | | |
|---|---|---|
| EP | 0381964 | 8/1990 |
| EP | 0704244 | 5/1996 |
| EP | 1580555 | 9/2005 |
| EP | 1655071 | 5/2006 |
| GB | 2129551 | 5/1984 |
| JP | 8304399 | 11/1996 |
| WO | WO90/14891 | 12/1990 |
| WO | WO92/16844 | 10/1992 |
| WO | WO93/22686 | 11/1993 |
| WO | WO99/20397 | 4/1999 |
| WO | WO99/59708 | 11/1999 |
| WO | WO2008/145709 | 12/2008 |
| WO | WO2008/145711 | 12/2008 |
| WO | WO2008/145712 | 12/2008 |

OTHER PUBLICATIONS

GB Application No. 0710189.2, Search Report mailed Aug. 31, 2007.
GB Application No. 0710188.4, Search Report mailed Sep. 11, 2007.
GB Application No. 0724426.2, Search Report mailed Apr. 14, 2008.
GB Application No. 0724404.0, Search Report mailed Apr. 9, 2008.
International Application No. PCT/EP2008/056645, Invitation to Pay Add'l Fees and Partial Search Report Mailed on Nov. 5, 2008.
International Application No. PCT/EP2008/056650, Office Action mailed on Nov. 3, 2009.
International Application No. PCT/EP2008/056649, International Preliminary Examination Report mailed Dec. 29, 2008.
International Application No. PCT/EP2008/056649, Written Report mailed Dec. 29, 2008.
International Application No. PCT/EP2008/056649, International Search Report mailed Dec. 29, 2008.

* cited by examiner

MAGNETIC SEPARATION RACK

The present application is the national stage filing of International Application No. PCT/EP2008/056645, filed May 29, 2008, which claims priority to United Kingdom Patent Application No. GB0710188.4, filed May 29, 2007; United Kingdom Patent Application No. GB0710189.2, filed May 29, 2007; U.S. Provisional Application No. 60/940,629, filed May 29, 2007; U.S. Provisional Application No. 60/940,614, filed May 29, 2007; United Kingdom Patent Application No. GB0724426.2, filed Dec. 14, 2007; United Kingdom Patent Application No. GB0724404.9, filed Dec. 14, 2007; U.S. Provisional Application No. 61/014,624, filed Dec. 18, 2007; and U.S. Provisional Application No. 61/014,627, filed Dec. 18, 2007; all of which are hereby incorporated by reference.

FIELD OF DISCLOSURE

This invention relates to a magnetic separation rack for isolating magnetically labeled particles from a non-magnetic medium.

BACKGROUND TO DISCLOSURE

The use of a high-gradient magnetic field to separate magnetically attractable particles from a fluid in which they are suspended is well known. Moreover, magnetic separation devices are used in a variety of industries including pharmaceutical, medical, agricultural, scientific and engineering fields. For example in biotechnology, a high-gradient magnetic field may be used to separate magnetically labeled bone marrow cells from a blood sample.

WO 90/14891 DYNAL A.S. discloses a conventional magnetic separation device whereby a test-tube/sample vessel, containing a fluid in which magnetically labeled particles are suspended, is arranged adjacent a strong magnet. The labeled particles are magnetically attracted to the side of the test-tube nearest the magnet. Thus, the supernatant is easily removable from the test-tube using a pipette whilst the magnetically labeled particles are left in the tube.

In order to save time, it is often desirable to process a large number of samples at once using a linear rack-like arrangement or tray-like arrangement. For example, the magnetic separating device disclosed in WO 90/14891 DYNAL A.S. comprises a rack for supporting a plurality of specimen containers. At least one magnet is arranged adjacent the rear portion of each test-tube such that the magnetic particles are attracted and adhere to the inside surface of the test-tube nearest the magnet; i.e. the interior surface at the rear of the sample vessel.

U.S. Pat. No. 4,896,560 GEN PROBE INC also discloses a magnetic separation rack where only one magnet is arranged immediately adjacent each test-tube. In this case, the magnet is arranged to one side of the test-tube and at an upper portion thereof.

It has been found that the separation of magnetically labeled particles is somewhat limited and restricted by the use of magnets on only one side of a test-tube. Moreover, the separation of magnetically labeled particles from a fluid is unsatisfactory if only a portion of the sample is subject to a magnetic field.

Whilst a rack-like arrangement is convenient for simultaneously processing a large number of samples, it is well known that the visual inspection of a sample vessel placed within a rack-like arrangement is imperfect. Some effort has been made to overcome this problem. For example, WO 90/14891 DYNAL A.S. provides a transparent plate so that an upper part of the test-tube is more clearly visible. Nevertheless, a lower portion of the test-tube is still hidden from view.

A magnetic separation rack comprises multiple chambers to receive test-tubes/sample vessels. The chambers are configured to have a predetermined diameter and depth. Obviously, the magnetic separation rack may only receive test-tubes having a diameter less than the diameter of the chamber. Thus, a magnetic separation rack is often restricted to processing samples in test-tubes of a particular range of diameters. Moreover, a sample vessel placed within a magnetic separation rack that is shorter in length than the depth of the chamber will be difficult to retrieve from the chamber and a sample vessel placed within a magnetic separation rack that is substantially longer in length than the depth of the chamber may mean that only a part of the sample is subject to a magnetic field.

Accordingly, there is a need to provide a magnetic separation device that can alleviate and/or overcome at least some of the above-mentioned problems. More specifically, the invention seeks to provide a magnetic separation rack that is suitable for processing a plurality of samples in an array. The invention seeks to provide a magnetic separation rack that can separate magnetically labeled particles more efficiently than the prior art. The present invention seeks to provide a magnetic separation device wherein a sample vessel mounted in the device is visible so that the inspection of the sample is easier than the prior art. The present invention also seeks to provide a magnetic separation device that is suitable for receiving different size sample vessels.

BRIEF SUMMARY OF THE DISCLOSURE

According to a first aspect of the disclosure, there is provided a magnetic separation rack for isolating magnetically labeled particles from a non-magnetic medium comprising a body portion having:

- an array of sample vessel retaining portions, each sample vessel retaining portion comprising at least one visible portion; and
- a plurality of magnetising portions arranged within the body portion such that at least two magnetising portions are circumferentially spaced about each sample vessel retaining portion;

a foot portion having:

- a surface by which the body portion may stand on a supporting surface;

wherein the foot portion is pivotally coupled to the body portion such that the body portion is operatively tiltable with respect to the foot portion.

Preferably, the plurality of magnetising portions comprises a first magnetising portion and second magnetising portion that are mounted in parallel relation on opposing sides and proximate each sample vessel retaining portion.

Each magnetising portion may comprise at least one magnet.

The at least one magnet may be configured within each magnetising portion such that a main volume of a sample vessel mounted within each sample vessel retaining portion is subject to the magnetic field.

The at least one magnet may be further or alternatively configured within each magnetising portion such that a tip of a sample vessel mounted within each sample vessel retaining portion is subject to the magnetic field.

Preferably, the at least one magnet in each magnetising portion is configured such that a substantial portion of a sample vessel mounted within each sample vessel retaining portion is encompassed by magnetic material. More particularly, the at least one magnet comprises a concave face that is shaped at least approximately to conform to a certain portion of the sample vessel.

The at least one visible portion is preferably an aperture or transparent portion such that at least one portion of a sample vessel mounted in each sample vessel retaining portion is visible to a user. Moreover, the at least one visible portion of the sample vessel is preferably a portion extending at least substantially along the length of the sample vessel retaining portion.

The magnetic separation rack may further comprise at least one light emitting diode to illuminate the at least one visible portion of the sample vessel retaining portion.

Furthermore, the magnetic separating rack may comprise at least one magnifying member to magnify a predetermined area of the at least one visible portion of the sample vessel retaining portion.

Each sample vessel retaining portion may comprise:

an aperture formed in an upper surface of the body portion; and a passage that extends at least substantially through the body portion from the aperture formed in the upper surface, wherein the aperture and passage are configured to receive and retain a sample vessel of a predetermined size.

Alternatively, each sample vessel retaining portion may comprise:

a first aperture formed in an upper surface of the body portion of a first predetermined width;

a second aperture formed in a lower surface of the body portion of a second predetermined width; and a passage extending through the body portion between the first aperture and the second aperture, wherein the first predetermined width of the first aperture is the same as or different to the second predetermined width of the second aperture.

When the first predetermined width of the first aperture is different to the second predetermined width of the second aperture, the foot may be pivotally coupled to the body portion such that the body portion is operatively rotatable with respect to the foot between a first orientation and a second orientation, wherein:

in the first orientation, the body portion is orientated such that a sample vessel of a first predetermined width may be received and retained in each sample vessel retaining portion via the first apertures, and in the second orientation, the body portion is orientated such that a sample vessel of a second predetermined width may be received and retained in each sample vessel retaining portion via the second apertures.

Preferably, the magnetic separation rack comprises a sample vessel supporting member having a supporting portion, the member being movable between a first position and second position, wherein:

in the first position, said portion of the sample vessel supporting member is located within the passage of each sample vessel retaining portion in a position effective to support a sample vessel, and in the second position, said portion of the sample vessel supporting member is located outside the passage of each sample vessel retaining portion.

Preferably, the magnetic separation rack comprises an aperture defining element having a plurality of aperture defining portions wherein each aperture defining portion comprises a plurality of aperture segments of different predetermined sizes;

whereby, the aperture defining element and the body portion are relatively movable between a range of positions and at any given position a selected aperture segment from each aperture defining portion is aligned with each sample vessel retaining portion.

According to a second aspect of the disclosure there is provided a method of isolating magnetically labeled particles from a non-magnetic medium using a magnetic separation rack as defined in the first aspect of the disclosure, comprising the steps of:

(i) mounting the sample vessel retaining portion on the magnetising portion;

(ii) subjecting a sample having magnetically labeled particles, contained in at least one sample vessel retained in the sample vessel retaining portion, to the magnetic field of the magnetising portion;

(iii) removing the non-magnetic supernatant.

According to a third aspect of the disclosure there is provided a magnetic separation rack for isolating magnetically labeled particles from a non-magnetic medium comprising a body portion having:

an array of sample vessel retaining portions, wherein each sample vessel retaining portion comprises:

a first aperture formed in an upper surface of the body portion of a first predetermined width;

a second aperture formed in a lower surface of the body portion of a second predetermined width;

a passage extending through the body portion between the first aperture and the second aperture, wherein the first predetermined width of the first aperture is the same as or different to the second predetermined width of the second aperture; and a plurality of magnetising portions arranged within the body portion such that at least two magnetising portions are circumferentially spaced about each sample vessel retaining portion.

When the first predetermined width of the first aperture is different to the second predetermined width of the second aperture, the magnetic separation rack of the third aspect of the disclosure may comprise orientation means operable to orientate the body portion between a first orientation and a second orientation, wherein:

in the first orientation, the body portion is orientated such that a sample vessel of a first predetermined width may be received and retained in each sample vessel retaining portion via the first apertures, and in the second orientation, the body portion is orientated such that a sample vessel of a second predetermined width may be received and retained in each sample vessel retaining portion via the second apertures.

The orientation means may comprise a foot portion pivotally coupled to the body portion such that the body portion is operatively rotatable with respect to the foot portion between the first orientation and the second orientation.

Preferably, the magnetic separating rack according to the third aspect of the disclosure comprises a sample vessel supporting member having a supporting portion, the member being movable between a first position and second position, wherein:

in the first position, said portion of the sample vessel supporting member is located within the passage of each sample vessel retaining portion in a position effective to support a sample vessel, and in the second position, said portion of the sample vessel supporting member is located outside the passage of each sample vessel retaining portion.

According to a fourth aspect of the disclosure there is provided a magnetic separation rack for isolating magnetically labeled particles from a non-magnetic medium comprising:

a body portion having:

an array of sample vessel retaining portions, a plurality of magnetising portions arranged within the body portion such that at least two magnetising portions are circumferentially spaced about each sample vessel retaining portion;

an aperture defining element having:

a plurality of aperture defining portions wherein each aperture defining portion comprises a plurality of aperture segments of different predetermined sizes;

whereby, the aperture defining element and the body portion are relatively movable between a range of positions and at any given position a selected aperture segment from each aperture defining portion is aligned with each sample vessel retaining portion.

BRIEF DESCRIPTION OF THE DRAWINGS

For a better understanding of the present disclosure and to show how it may be carried into effect, reference will be made, by way of example only, to the following drawings in which.

DETAILED DESCRIPTION

Figure 1A:
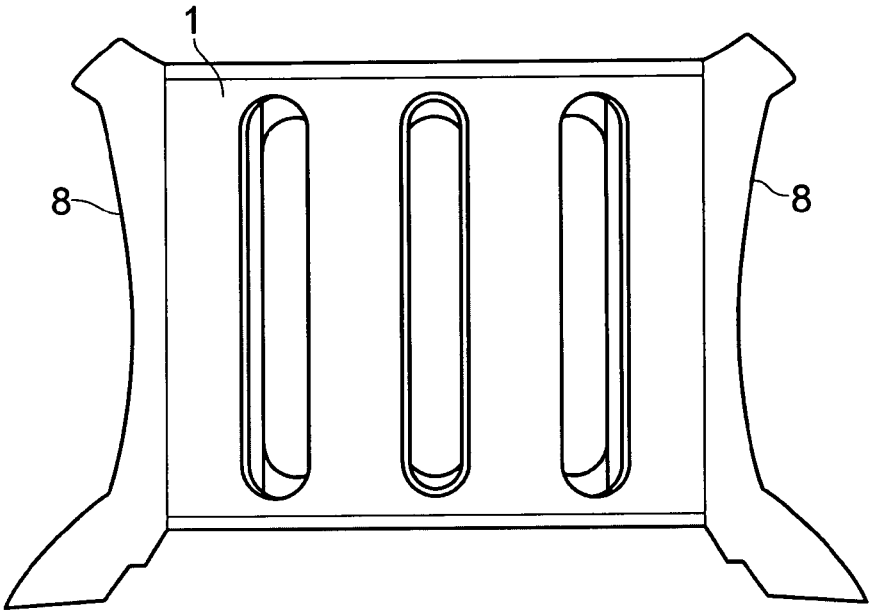
FIGS. 1*a* and 1*b* are a side-view and a schematic exploded perspective view respectively of a magnetic separation rack according to a first embodiment of the disclosure.

Referring now to the Figures of the illustrated embodiments of the disclosure, the first, second, third and fourth aspects of the disclosure relate to a magnetic separation rack comprising a body portion (1) whereby the body portion (1) comprises an array of sample vessel retaining portions (2) and a plurality of magnetising portions (3).

Each sample vessel retaining portion (2) is configured to receive and retain a sample vessel (4) such that one or more sample vessels may be mounted in the rack.

The plurality of magnetising portions (3) is arranged within the body portion (1) in order to provide a high-gradient magnetic field. At least two of the magnetising portions (3) are circumferentially spaced apart about each sample vessel retaining portion (2).

In the first and second aspects of the disclosure, the sample vessel retaining portion (2) comprises at least one visible portion (9) such that at least one portion of a sample vessel retained in the sample vessel retaining portion is visible to a user. In the third and fourth aspects of the disclosure, the sample vessel retaining portion (2) may optionally comprise at least one visible portion (9) such that at least one portion of a sample vessel retained in the sample vessel retaining portion is visible to a user.

In the first and second aspects of the disclosure, the magnetic separation rack comprises a foot portion (8) having a surface by which the body portion (1) may stand on a supporting surface. In the third and fourth aspects of the disclosure, magnetic separation rack may optionally comprise a foot portion (8) having a surface by which the body portion (1) may stand on a supporting surface.

In the first and second aspects of the disclosure, the foot portion (8) is pivotally coupled to the body portion (1) such that the body portion (1) is operatively tiltable with respect to the foot portion (8). In the third and fourth aspects of the disclosure, the foot portion (8) may be optionally pivotally coupled to the body portion (1) such that the body portion (1) is operatively tiltable with respect to the foot portion (8).

As mentioned above, a plurality of magnetising portions (3) are arranged within the body portion (1). Preferably, the magnetising portions (3) are configured such that at least two magnetising portions (first magnetising portion 3*a*, second magnetising portion 3*b*) are associated with each sample vessel (4). The first and second magnetising portions (3*a*, 3*b*) are mounted in parallel relation on opposite sides and proximate each sample vessel retaining portion (2). Thus, a sample vessel (4) retained within the sample vessel retaining portion (2) is located between at least the first and second magnetising portions (3*a*, 3*b*) and is therefore subject to a high-energy magnetic field.

Each magnetising portion (3) comprises at least one magnet. The at least one magnet provides a high-gradient magnetic field that is suitable for attracting and separating magnetically labeled particles from a fluid in which they are suspended. The at least one magnet of the respective magnetising portions (3) are configured such that they are diametrically opposed relative to one another. The at least one magnet may be made of ferromagnetic material such as iron, steel, cobalt-nickel etc. The at least one magnet may be a permanent magnet. The at least one magnet is preferably a high-energy neodymium permanent magnet. More specifically, the at least one magnet is preferably formed from a high performance rare earth alloy such as neodymium iron boron (NdFeB). In an alternative embodiment of the disclosure, the at least one magnet may be an electro-magnet.

Figure 5A:
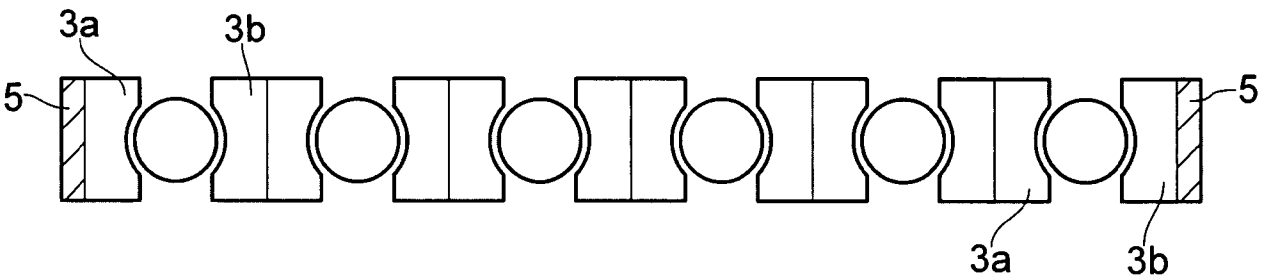
FIGS. 5*a* and 5*b* are a plan-view and side-view respectively showing how the magnetising portions may be arranged with respect to the sample vessel retaining portions.
Figure 5B:
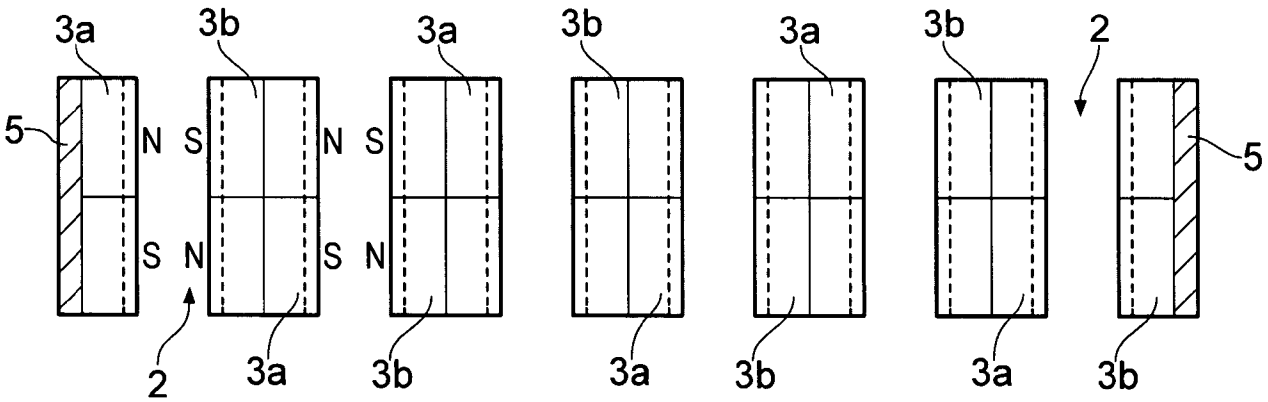
Figure 6A:
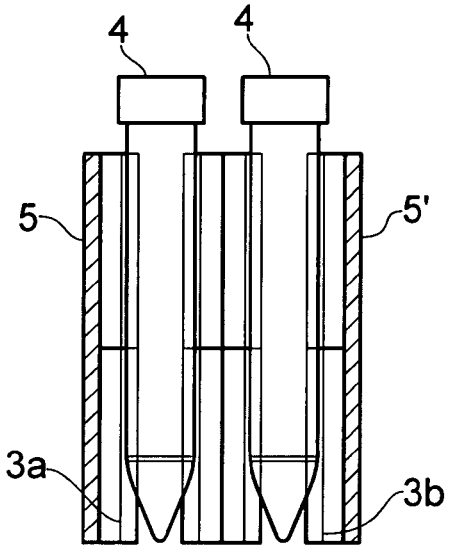
FIGS. 6*a*, 6*b* and 6*c* are a side-view, plan-view and side-view respectively showing how the magnetising portions may be arranged with respect to the sample vessels.
Figure 6B:
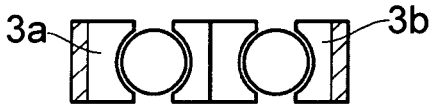
Figure 6C:
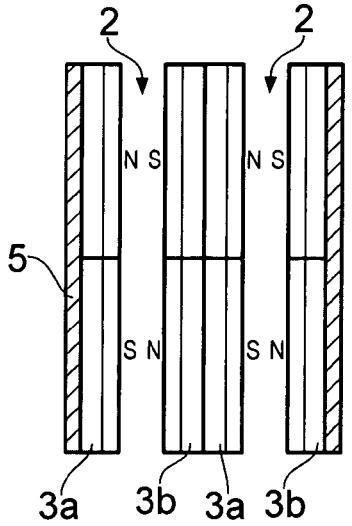
Figure 7A:
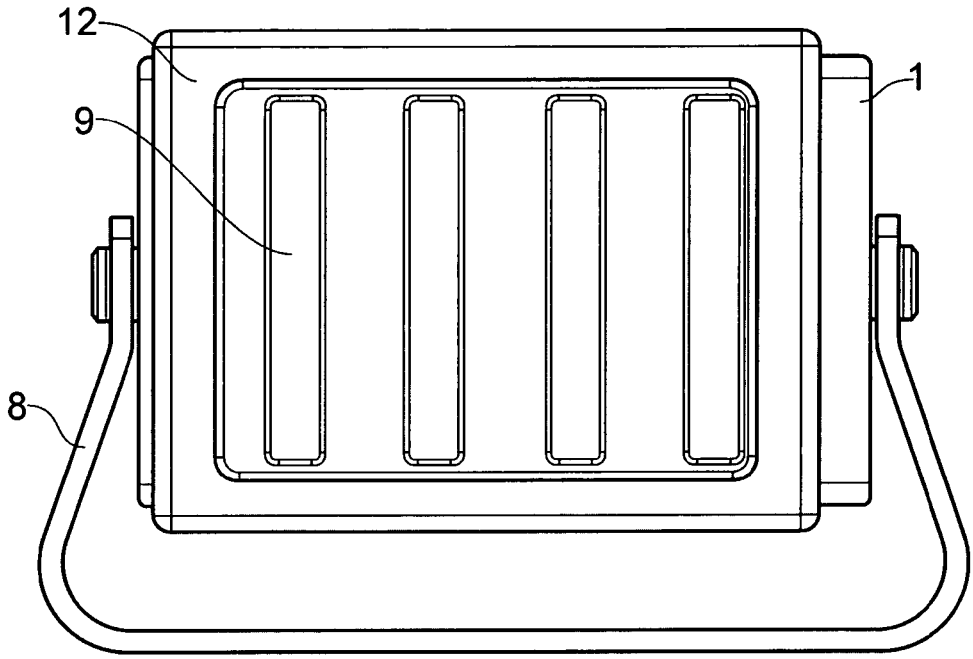
FIGS. 7*a*, 7*b* and 7*c* are a side-view, plan-view and perspective view respectively of a magnetic separation rack according to a third embodiment of the disclosure.
Figure 7B:
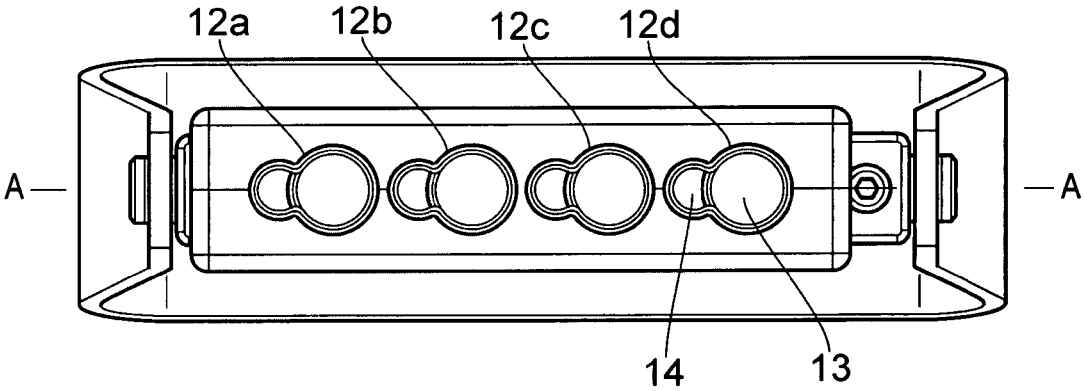
Figure 7C:
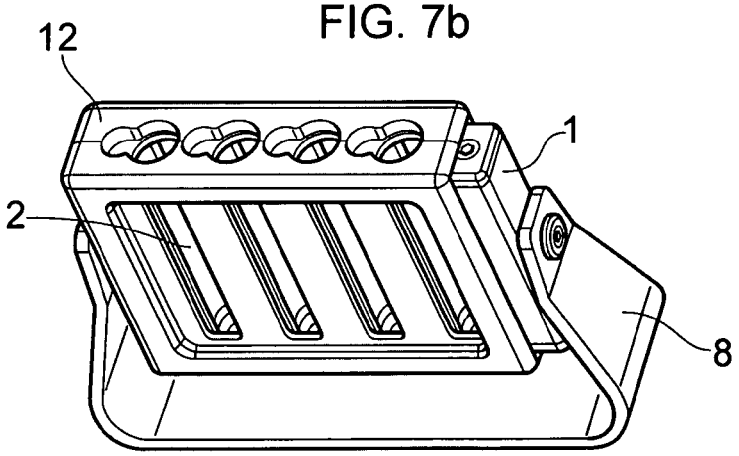
Figure 8:
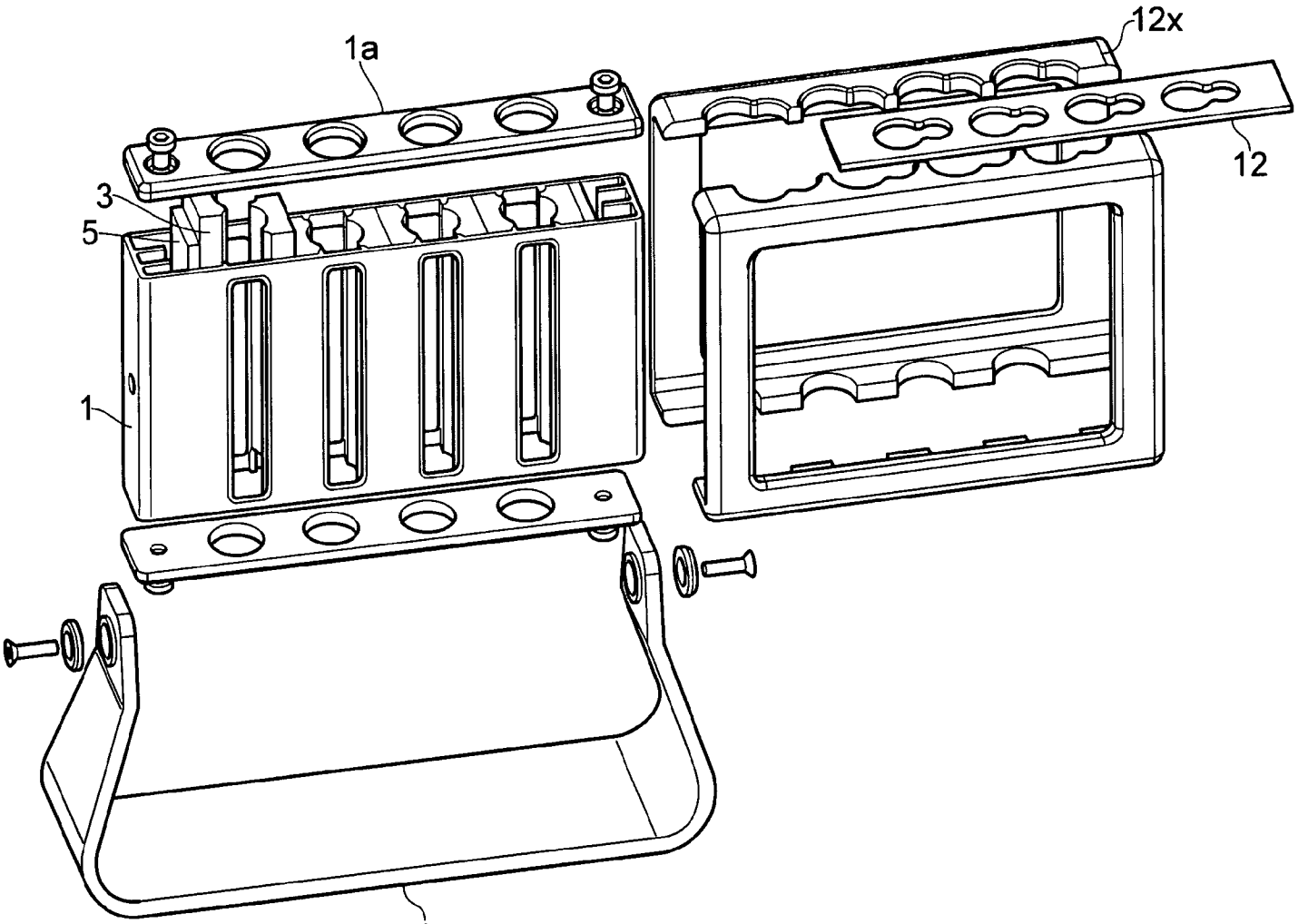
FIG. 8 is a schematic exploded perspective view of the magnetic separation rack according to the third embodiment of the disclosure.

FIGS. 1*b*, 5*a*, 5*b*, 6*a-c*, 8 and 11 show how a plurality of magnetising portions (3) may be mounted with respect to an array of sample vessel retaining portions (2). The magnetising portions (3) are configured such that a first magnetising portion (3*a*) and a second magnetising portion (3*b*) are arranged in close proximity to each sample vessel retaining portion. The first and second magnetising portions (3*a*, 3*b*) are arranged in parallel on either side of each sample vessel retaining portion (2). FIGS. 5*b*, 6*c* indicate the at least one magnet in the first magnetising portion (3*a*) is orientated such that it is diametrically opposed to the at least one magnet in the second magnetising portion (3*b*). Pole pieces (5) are mounted adjacent the end most magnetising portions in order to restrict the magnetic field.

Figure 4A:
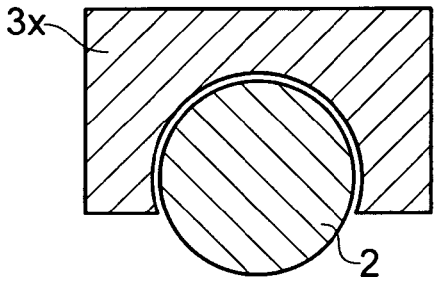
FIG. 4*a* is a plan-view showing a third configuration of a magnet with respect to a sample vessel and FIG. 4*b* is a plan-view showing a fourth configuration of a plurality of magnets with respect to a sample vessel.
Figure 4B:
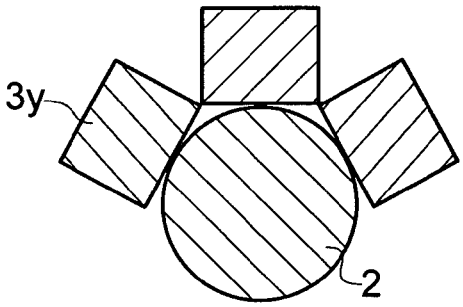
Figure 11:
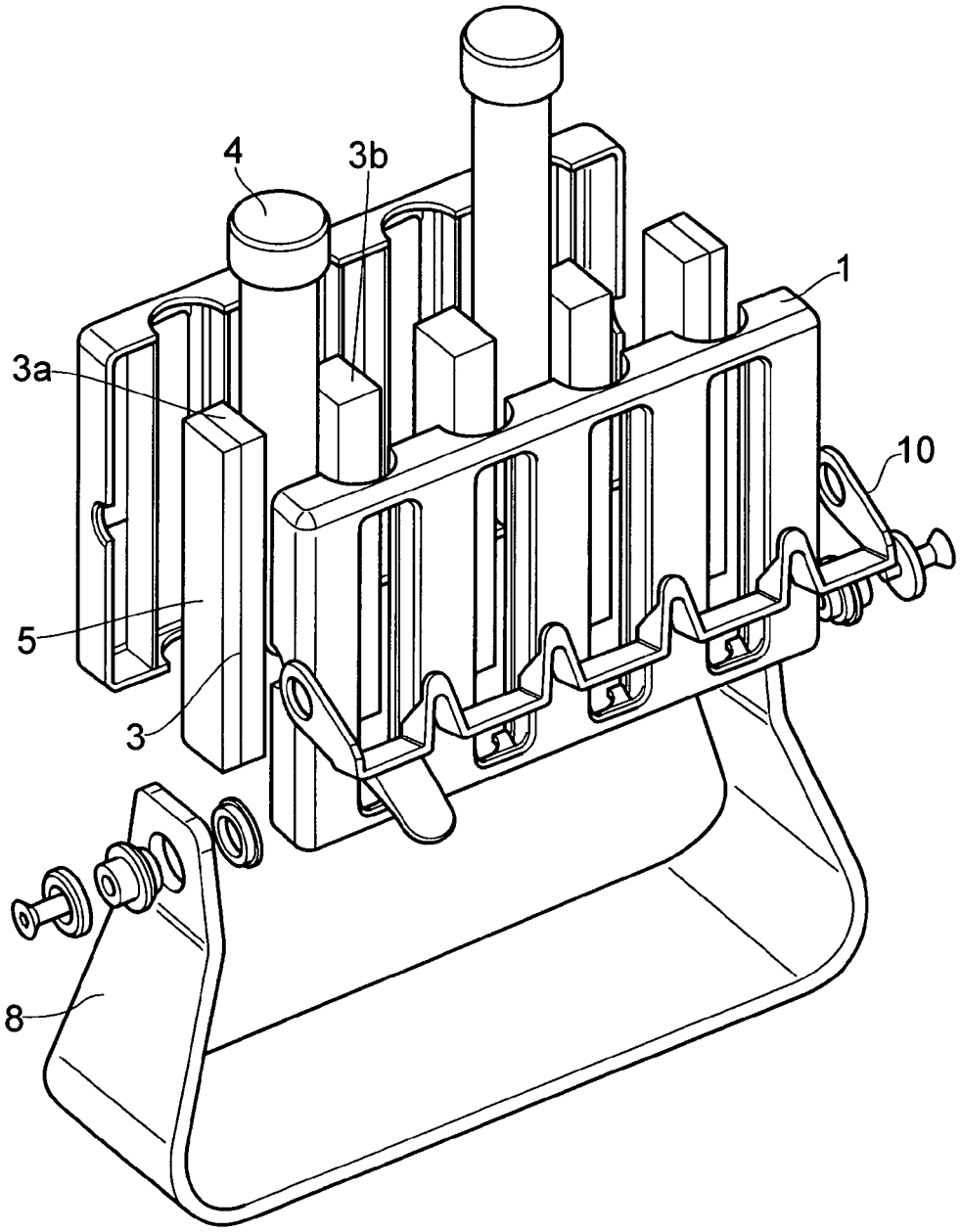
FIG. 11 is a schematic exploded perspective view of a magnetic separation rack according to a sixth embodiment of the disclosure.

The at least one magnet of the magnetising portions (3) is shaped and arranged such that a substantial portion of a sample vessel (4) is encompassed by magnetic material whilst a gap is provided that is suitable for viewing purposes. This may be achieved by shaping the at least one magnet of the magnetising portions (3) such that it has a face which conforms at least approximately to the shape of a sample vessel (4). Typically the conforming face is concave in nature, such as a part cylindrical surface. For example, the magnetising portion (3) may comprise an approximately U-shaped or C-shaped magnet (3*x*) as shown in FIGS. 1*b*, 4*a*, 5*a*, 6*b* and 8 whereby the concave face of the magnet (3*x*) encompasses a certain portion of the width of the sample vessel retaining portion (2). A high-gradient magnetic field of sufficient strength to isolate magnetically labeled particles may also be provided if the magnetising portions (3*a*,3*b*) arranged on either side of the sample vessel retaining portion comprise at least one conventional bar magnets (3*y*) having a substantially flat face as shown in FIG. 11. Alternatively, the magnetising portions may comprise at least one conventional bar magnet whereby the bar magnets are arranged to encircle or envelop a certain portion of the width of the sample vessel retaining portion (2) as shown in FIG. 4*b*.

The at least one magnet may be mounted within a housing which defines a void, cavity or chamber for receiving the at least one magnet. The housing is provided to protect the at least one magnet. For example, the housing may be provided to prevent corrosion, damage or fluid contact with the at least one magnet. If a given magnetising portion (3) comprises only one magnet, then the magnet may be alternatively protected by a coating. Clearly, the housing or coating must be made from a material or materials that are non-magnetic. The housing or coating material is preferably easy to clean and resistant to disinfectant and/or other aggressive chemicals.

When a sample vessel (4) is received and retained by a sample vessel retaining portion (2) it is arranged between the first and second magnetising portions (3*a*, 3*b*) such that it is subject to a high-gradient magnetic field. Consequently, the magnetically labeled particles suspended within a sample are attracted by the magnetising portions (3*a*, 3*b*) and immobilised at selected regions along the interior surface of the sample vessel (4). These selected regions are sections or zones of the interior surface of the sample vessel (4) adjacent the magnetising portions; i.e. regions of the interior surface closest to the at least one magnet mounted within the first and second magnetising portions (3*a*, 3*b*).

By arranging a pair of magnetising portions (3*a*, 3*b*) in parallel relation, on opposing sides of and proximate each sample vessel retaining portion (2) a high-gradient magnetic field is generated that is much stronger than that produced in a conventional magnetic separation rack having just one magnetising portion associated with each sample vessel retaining portion. By arranging a pair of magnetising portions (3*a*, 3*b*) in parallel relation on opposite sides of and proximate each sample vessel retaining portion (2) a plurality of magnetic surfaces are provided. Thus, magnetically labeled particles are separated from the non-magnetic medium more quickly and migrate to a plurality of selected regions along the interior of the sample vessel (4); selected regions adjacent the first and second magnetising portions (3*a*, 3*b*). The use and configuration of the magnetising portions (3*a*, 3*b*) in the present disclosure helps to provide a more accurate and efficient magnetic separation rack as compared with the prior art.

Figure 3A:
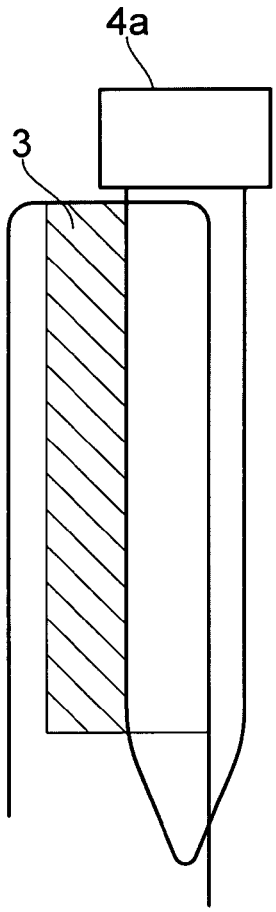
FIG. 3*a* is a side-view showing a first configuration of a magnet with respect to a sample vessel and FIG. 3*b* is a side-view showing a second configuration of a magnet with respect to a sample vessel.
Figure 3B:
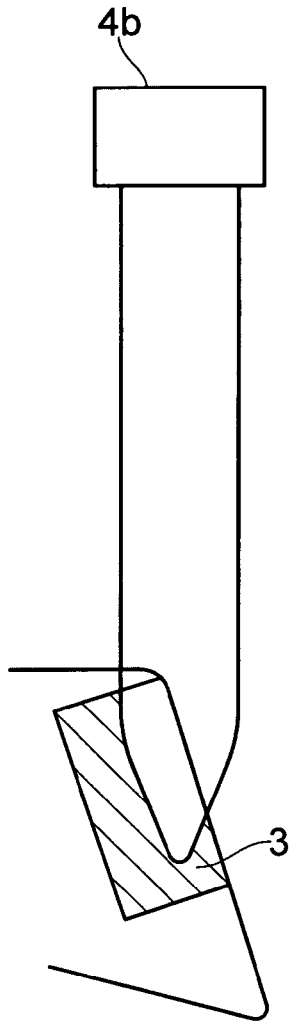

In an embodiment of the disclosure the at least one magnet of the magnetising portions (3) may be shaped and arranged such that at least a main volume of each associated sample vessel (4) is subject to a high-gradient magnetic field. Alternatively, the at least one magnet of the magnetising portions (3) may be shaped and arranged such that only the tip of each associated sample vessel (4) is subject to a high-gradient magnetic field. FIGS. 3*a* and 3*b* are provided to illustrate these optional features. FIG. 3*a* depicts an arrangement where only the main body of a first sample vessel (4*a*) is arranged between a parallel pair of magnetising portions (3) and FIG. 3*b* depicts an arrangement where only the tip of a second sample vessel (4*b*) is arranged between a parallel pair of magnetising portions (3).

The body portion (1) of the magnetic separation rack preferably comprises an upper surface (1*a*), lower surface (1*b*), front wall (1*c*), back wall (1*d*) and two side walls (1*e*, 1*f*). Clearly, the body portion must be formed from a non-magnetic material. The material is preferably easy to clean and resistant to disinfectant and/or other aggressive chemicals.

As mentioned above, a sample vessel retaining portion (2) is suitable for receiving and retaining a sample vessel (4). The sample vessel retaining portion (2) may be sized and shaped to receive and retain sample vessels of any conventional size and in particular sample vessels having a diameter up to 30 mm and volumes typically ranging from about 5 to 50 ml. Alternatively, the sample vessel portion (2) may be configured to retain much smaller vessels, for example 0.5 to 2.0 ml micro-centrifuge tubes available from Eppendorf A. G., Hamburg, Germany.

Each sample vessel retaining portion (2) is in some preferred embodiments defined by the minimum number of integers required to provide stable location of the sample vessel in its position of use. Moreover, the sample vessel retaining portions (2) are typically at least partially defined by the circumferentially mounted magnetising portions (3).

As with any conventional rack, the magnetic separation rack of the disclosure may comprise a one dimensional array of sample vessel retaining portions (2) or a two-dimensional array of sample vessel retaining portions (2). For example, the magnetic separation rack may comprise a single row (one dimensional linear array) of sample vessel retaining portions (2) as depicted in the Figures. Alternatively, the magnetic separation rack may comprise two rows of sample vessel retaining portions (2) or even a plurality of sample vessel retaining portions (2) arranged in rows and columns (two dimensional array).

Each sample vessel retaining portion (2) comprises an aperture (6) formed in the upper surface (1*a*) of the body portion (1) and a passage (7) that extends at least substantially through the body portion (1) from the aperture (6) in the upper surface (1*a*). The aperture (6) and passage (7) are sized and shaped such that they are suitable for receiving sample vessels (4) of a predetermined width and volume/length. It is noted that the passage (7) need not be completely defined by integers such as the magnetising portions (3) and walls of the body portion. Gaps or spaces may be provided between such integers, provided only that the sample vessel can be safely and stably retained in its position of use.

The aperture (6) formed in the upper surface (1*a*) of the sample vessel retaining portion (4) may be configured such that a rim of a sample vessel (4) of a predetermined width abuts the peripheral edge of the aperture (6) such that the sample vessel (6) is mounted on or retained at the upper surface (1*a*). Depending on the volume/length of the sample vessel and the depth of the passage, a sample vessel (4) may be further or alternatively supported by an end face of the passage (7). The sample vessel (4) may be further or alternatively supported within the passage (7) using a supporting member (10) which is described in more detail below.

Figure 1B:
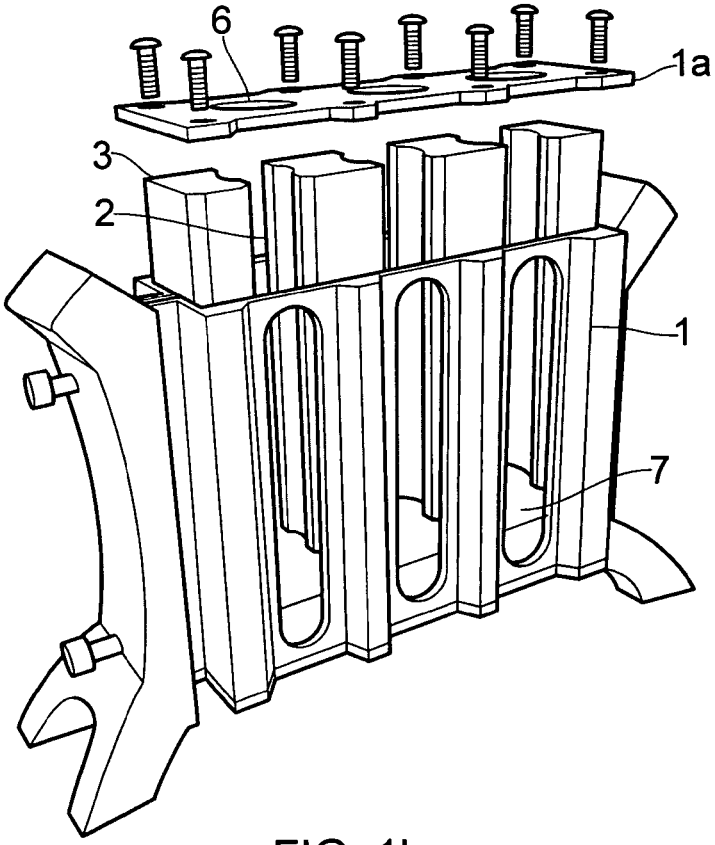

FIGS. 1*a* and 1*b* depict an embodiment of the magnetic separation rack comprising three sample vessel retaining portions (2). Each sample vessel retaining portion comprises an aperture (6) formed in the upper surface (1*a*) of the body portion (1) and a passage (7) that extends through the body portion (1) from the aperture (6) in the upper surface (1*a*) to the lower surface (1*b*) of the body portion (1). The size of the sample vessel that may be received and retained by the magnetic separation rack depicted in FIGS. 1*a* and 1*b* is determined by the configuration of the apertures (6) and passages (7) of the sample vessel retaining portions (2). Thus, the magnetic separation rack depicted in FIGS. 1*a* and 1*b* is suitable for receiving and retaining samples of a predetermined width and volume/length.

Each sample vessel retaining portion (2) may further comprise an aperture (6*b*) formed in the lower surface (1*b*) of the body portion (1) such that the passage extends through the body portion between the aperture (6*a*) formed on the upper surface (1*a*) and the aperture (6*b*) formed on the lower surface (1*b*). The aperture (6*b*) formed at the lower surface (1*b*) may be configured such that the tip of a sample vessel abuts the peripheral edge of the aperture such that the sample vessel (4) is mounted or retained at the lower surface (1*b*). The tip of the sample vessel (4) may also protrude through the aperture (6*b*) in the lower surface (1*b*). This type of arrangement is depicted in the FIG. 12*a*.

In the embodiments depicted in FIGS. 2*a-b*, 11, 12*a-c* and 13*a-c* each sample vessel retaining portion (4) comprises a first aperture (6*a*) formed in the upper surface (1*a*) of the body portion (1) of a first predetermined width, a second aperture (6*b*) formed in the lower surface (1*b*) of the body portion (1) of a second different predetermined width and a passage (7) that extends through the body portion (1) between the first aperture (6*a*) and the second aperture (6*b*). Thus, the magnetic separation rack disclosed in FIGS. 2*a-b*, 11, 12*a-c* and 13*a-c* is suitable for receiving and retaining sample vessels of two different predetermined sizes by orientating the body portion (1) accordingly. The body portion (1) may be orientated by rotating/"flipping-over" the body portion (1). This may be achieved by providing orientation means to orientate the body portion as required. The orientation means may include pivotal coupling means to pivotally coupling the foot portion (8) and body portion (1) such that the body portion is operatively rotatable with respect to the body portion by at least approximately 180°. The pivotal coupling means may comprise hinges, axel pins or other conventional pivoting means. Hence, the rotatable body portion (1) may be orientated to a first orientation such that sample vessels of a first predetermined width may be received and retained in the sample vessel retaining portion (2) via the first apertures (6*a*). Alternatively, the rotatable body portion (1) may be orientated by rotating the body portion (1) by approximately 180° with respect to the foot portion (8) around axis A (see FIG. 2*b*) to the second orientation such that the sample vessels of a second predetermined width may be received and retained in the sample vessel retaining portion (2) via the second apertures (6*b*)—as shown in FIGS. 2*a-b*, 11, 12*a-c* and 13*a-c*.

As mentioned above, each sample vessel retaining portion (2) may comprise at least one visible portion (9). The at least one visible portion (9) may be an aperture and/or at least one transparent portion such that at least one portion of a sample vessel mounted in the sample vessel retaining portion (2) is visible. The visible portion of the sample vessel is preferably a portion extending at least substantially along the length of the sample vessel. The apertures or transparent portions are preferably formed in the front wall and/or rear wall of the body portion adjacent each passage of a sample vessel retaining portion (2).

Figure 2A:
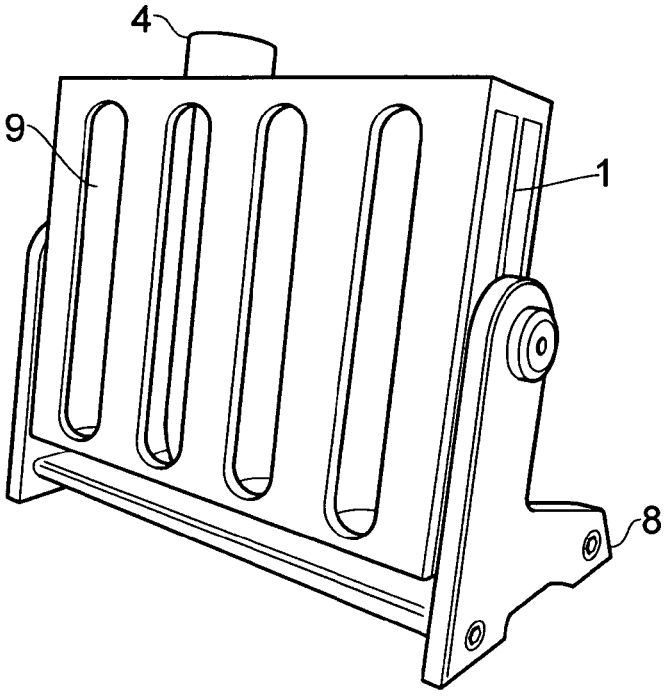
FIGS. 2*a* and 2*b* are a perspective view of the front of a magnetic separation rack and a perspective view of the back of a magnetic separation rack respectively according to a second embodiment of the disclosure.
Figure 2B:
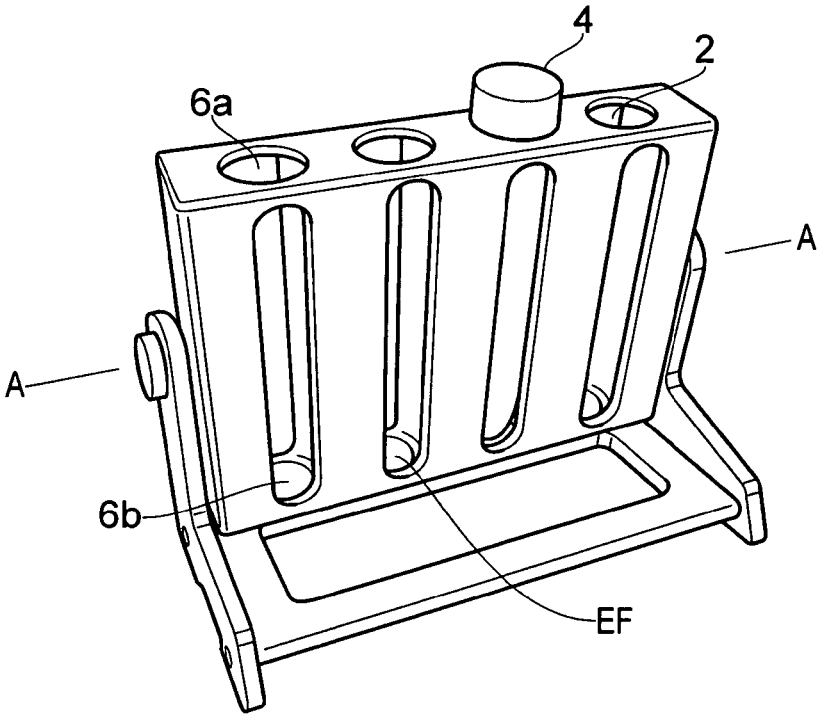

FIGS. 1*a-b*, 7*a-c*, 8, 9*a-b*, 10, 11, 12*a-c* and 13*a-c* depict embodiments of the disclosure where each sample vessel retaining portion (2) comprises two viewing apertures (9) extending longitudinally and substantially along the length of the passage (7) such that a substantial length of a sample vessel (4) mounted in the sample vessel retaining portion (2) can be seen through the viewing apertures (9) formed in the front wall (1*c*) and rear wall (1*d*) of the body portion (1). FIGS. 2*a* and 2*b* show an alternative arrangement where each sample vessel retaining portion (2) comprises two transparent regions (9) that extend longitudinally and substantially along the length of the passage (7) such that a substantial length of a sample vessel (4) mounted in a sample vessel retaining portion (2) is visible through the front wall (1*c*) and the rear wall (1*d*) of the body portion (1).

A skilled person will appreciate that the visible portions (9) are suitable for a magnetic separation rack of the disclosure having a linear, one dimensional array of sample vessel retaining portions (2) or a magnetic separation rack of the disclosure having two rows of sample vessel retaining portions (2) whereby a first linear array of sample vessel retaining portions (2) is arranged to extend linearly along the front wall (1*c*) of the body portion (1) and a second linear array of sample vessel retaining portions (2) is arranged to extend linearly along the back wall (1*d*) of the body portion (2).

Providing at least one visible portion that extends at least substantially along the length of the sample vessel means that the sample vessel may be viewed more easily. This is a significant advantage over prior art magnetic separation racks where inspection of the sample vessels is somewhat restricted and often necessitates the removal of the sample vessels from the rack.

So as to further improve the visibility of the sample vessel (4), the magnetic separation rack may be provided with lighting means to illuminate the sample vessel (4). Inspection of the sample vessel is improved when the lighting means particularly illuminate the at least one visible portion of the sample vessel retaining portion as mentioned above. The lighting means may include one or more light emitting diodes (LED). The one or more LED may be mounted within the passage (7) of the sample vessel retaining portion (2) or within the body portion (1), without obstructing the entry or exit of the sample vessels (4). The one or more LED is preferably mounted in the end face of the passage (7) of each sample vessel retaining portion (2) that is, in the general area labeled EF.

The magnetic separation rack may be further or alternatively provided with magnifying means to magnify at least a predetermined region of a sample vessel (2). The magnifying means is preferably arranged such that it magnifies at least a region of the at least one visible portion of the sample vessel as discussed above. Clearly, the magnifying means are provided to help further improve the visibility of the sample. The magnifying means may be a lens located in the one or more viewing apertures (9) configured to provide a visible portion of the sample vessel (4). The magnifying means may alternatively be a lens located adjacent or integrated as part of the one or more transparent portions (9) configured to provide a visible portion of the sample vessel (4).

The magnetic separation rack may further comprise at least one foot portion (8). The at least one foot portion is configured to enable the device to stand on a supporting surface such as a work station, shelf, table or the like. In its simplest form, the foot portion (8) may be a surface by which the body portion (1) may stand on a supporting surface. The foot portion (8) and body portion (1) may be provided as a unitary component. Alternatively, the foot portion (8) and body portion (1) may be separate elements.

As mentioned above, the foot portion (8) may be pivotally coupled to the body portion (1) such that the body portion (1) is operatively tiltable with respect to the foot portion (8). The foot portion (8) is pivotally coupled to the body portion (1) using pivotal coupling means. The pivotal coupling means may comprise hinges, axel pins and other conventional pivotal coupling means known to the skilled person in the art. The body portion (1) may be tiltable from a substantially vertical position by an angle of up to and including approximately 70°. The body portion (1) is preferably tiltable from a substantially vertical position to an angle ranging between approximately 30° and 60°. By tilting the body portion (1) from a substantially vertical position a sample vessel may be viewed more easily through the at least one visible portion (9) of the sample vessel retaining portion (2).

Due to the at least one visible portion and pivotal coupling means a sample vessel may be inspected easily and simply without having to remove the sample vessel from the sample vessel retaining portion. The use and configuration of the at least one visible portion and the pivotal coupling in the present disclosure helps to improves the inspection of the sample vessels and at least substantially overcomes the visibility problems associated with the prior art.

FIGS. 1*a-b*, 2*a-b*, 11, 12*a-c* and 13*a-c* depict embodiments of the disclosure that comprise a foot portion (8) which is pivotally coupled each side-wall of the body portion (1). This particular foot portion (8) not only enables the device to stand on a supporting surface, but it also enables the body portion (1) to be tilted as required. For example, the body portion (1) may be tilted around axis A by an angle of approximately 45° with respect to the vertical, as shown in FIGS. 2*a* and 2*b*, so that the user can easily inspect the sample vessels retained within sample vessel retaining portions.

Figure 9B:
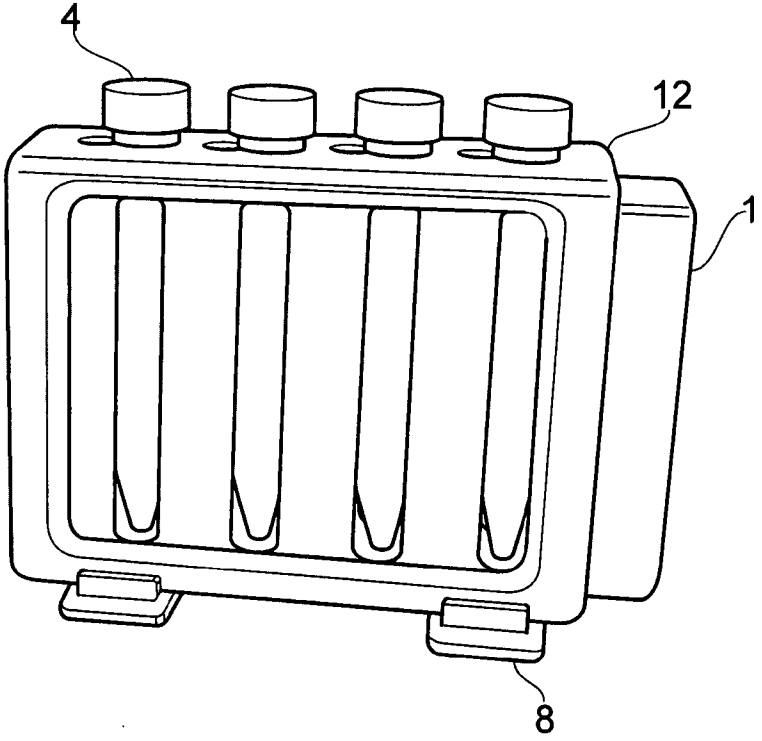
FIGS. 9*a* and 9*b* are perspective views of a magnetic separation rack in a first and second position respectively according to a fourth embodiment of the disclosure.
Figure 9A:
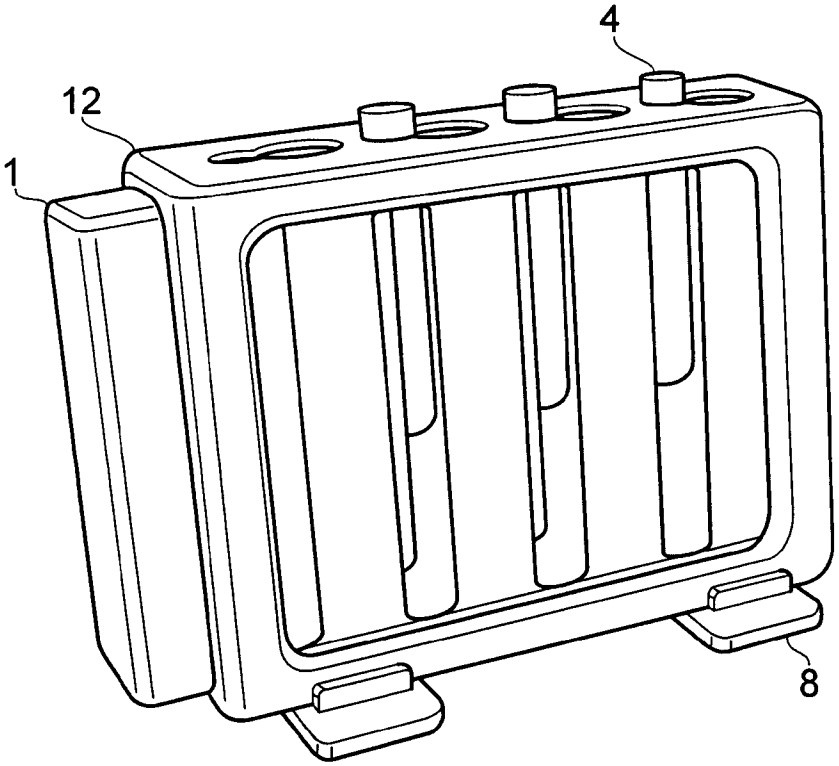
Figure 10:
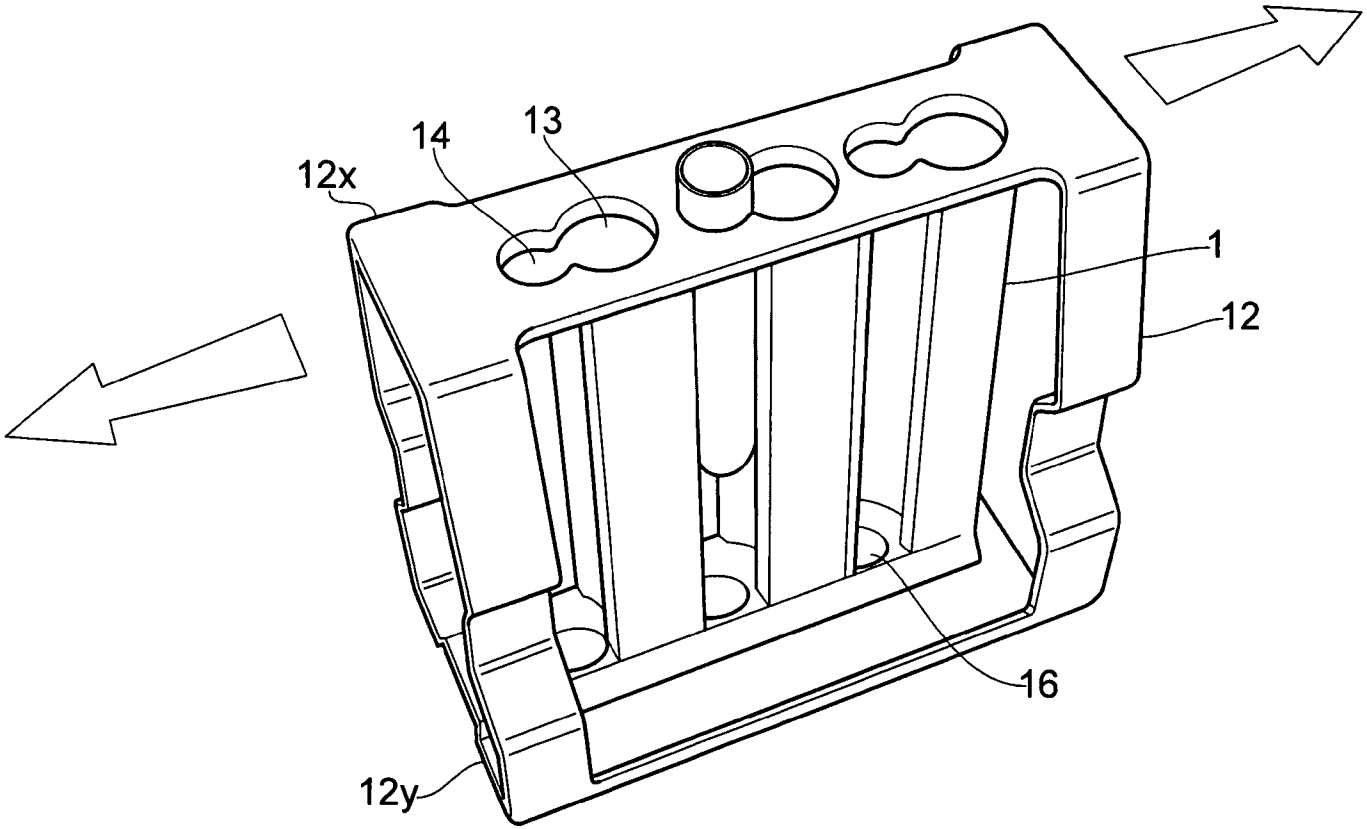
FIG. 10 is a perspective view showing the first and second positions of the magnetic separation rack according to a fifth embodiment of the disclosure.

FIGS. 9*a* and 9*b* depict an embodiment of the disclosure wherein the foot portion (8) comprises a pair of feet (8*a*). The pair of feet (8*a*) may be pivotally coupled to the lower surface of the frame (12) such that the frame (12) and body portion (1) are operatively tiltable with respect to the feet (8*a*). FIG. 10 depicts an embodiment of the magnetic separation rack that comprises a frame (12) (the aperture defining element—see later) which is mounted around the body portion (1) wherein a lower portion or lower surface (12*y*) of the frame acts as a foot portion when the rack is mounted such that sample vessels (4) may be received in each sample vessel retaining portion via apertures formed in the upper surface (12*x*) of the frame (12). The frame (12) may be pivotally coupled to the body portion (1), for example the upper surface of the body portion (1), such that the body portion (1) is tiltable from a substantially vertical position within the frame.

The magnetic separation rack may further or alternatively comprise a sample vessel supporting member (10). At least a portion of the sample vessel supporting member (10) is locatable within the sample vessel retaining portions (2) and is provided to support the tip of a sample vessel (4) within the passage (7) of the sample vessel retaining portion. The sample vessel supporting member (10) is movable between a first and a second position such that the relevant portion thereof can be located within the passage (7) when required. In the first position, the portion of the sample vessel supporting member (10) is located within the passage (7) of the sample vessel retaining portion (2). In the second position, the sample vessel supporting member (10) is spaced apart or located outside the passage (7). The relevant portion of the sample vessel supporting member (10) is locatable within the passage (7) of the sample vessel retaining portion (2) by inserting said portion through an aperture formed in the front and/or back wall of the body portion (1) adjacent each passage (7). This aperture may be the viewing which permits a user to view a portion of the sample vessel as discussed above. The sample vessel supporting member (10) may be moved between the first and second position by sliding or pivoting the sample supporting member (10) with respect to the body portion (1).

Figure 12A:
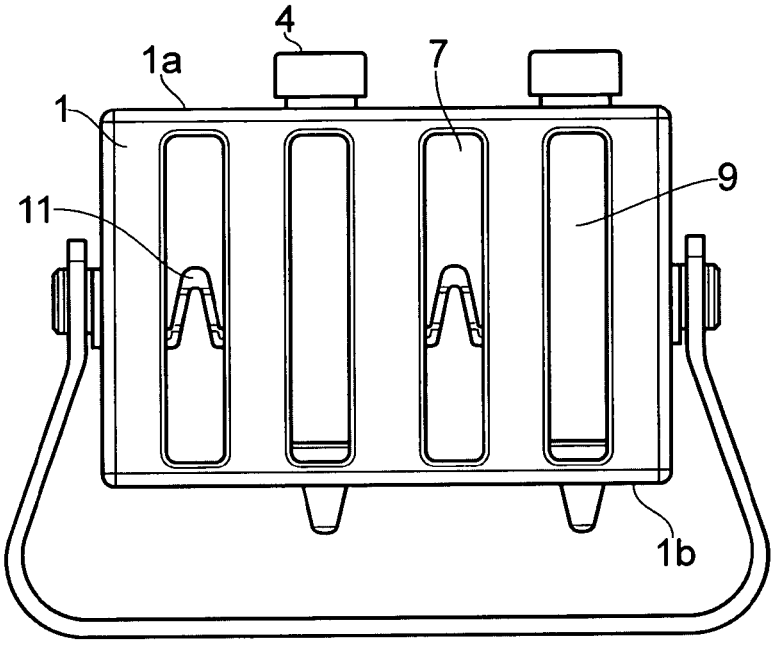
FIGS. 12*a*, 12*b* and 12*c* are a side-view, plan-view and perspective view of the magnetic separation rack according to the sixth embodiment of the disclosure when adapted to retain larger sample vessels.
Figure 12B:
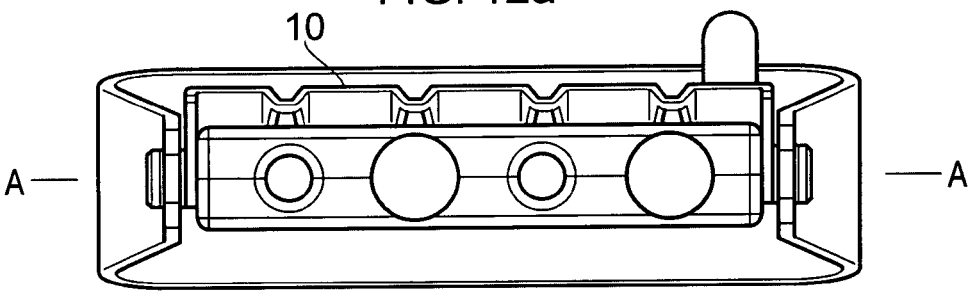
Figure 12C:
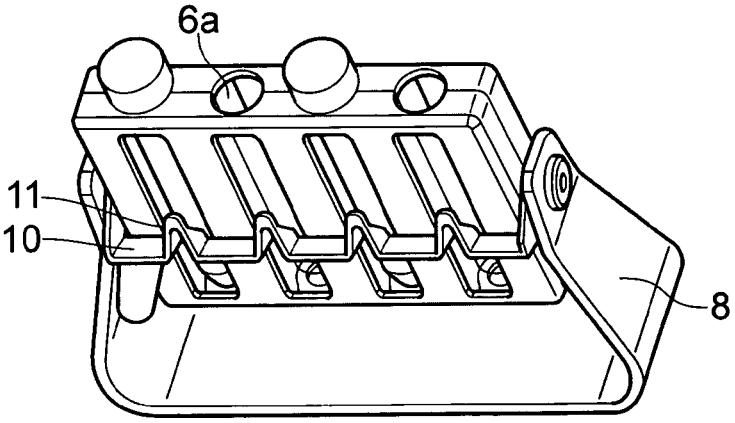

FIGS. 12*a-c* and 13*a-c* depict an embodiment of the disclosure comprising a sample vessel supporting member (10). The sample vessel supporting member (10) is pivotally coupled to the body portion (1) such that it may be pivoted between a first position and a second position. In the first position, the sample vessel supporting member (10) is arranged externally to the body portion (1) and is not located within the passages (7) of the sample vessel retaining portions (2). In the second position, the sample vessel supporting member (10) is arranged such that a supporting portion (11) of the sample vessel supporting member (10) is located within the passage (7) of each sample vessel retaining portion (2). In FIGS. 12*a-c* the magnetic separation device is arranged to receive and retain samples vessels of a first predetermined size, e.g. "Falcon" test-tubes available under the Falcon brand from B.D. Falcon, New Jersey, U.S.A. The sample vessels of the first predetermined size are mounted within the sample vessel retaining portions (2) via the first apertures (6*a*) that are formed on the upper surface (1*a*) of the body portion (1). The sample vessels of the first predetermined size are configured such that the main volume of the sample vessel is arranged within the passage (7) of the sample vessel retaining portion (2) and the tip of the sample vessel protrudes through the aperture formed in the lower surface (1*b*) of the body portion (1). Hence, the sample vessel supporting member (10) is not required and is therefore mounted in the first position outside the body portion (1).

Figure 13A:
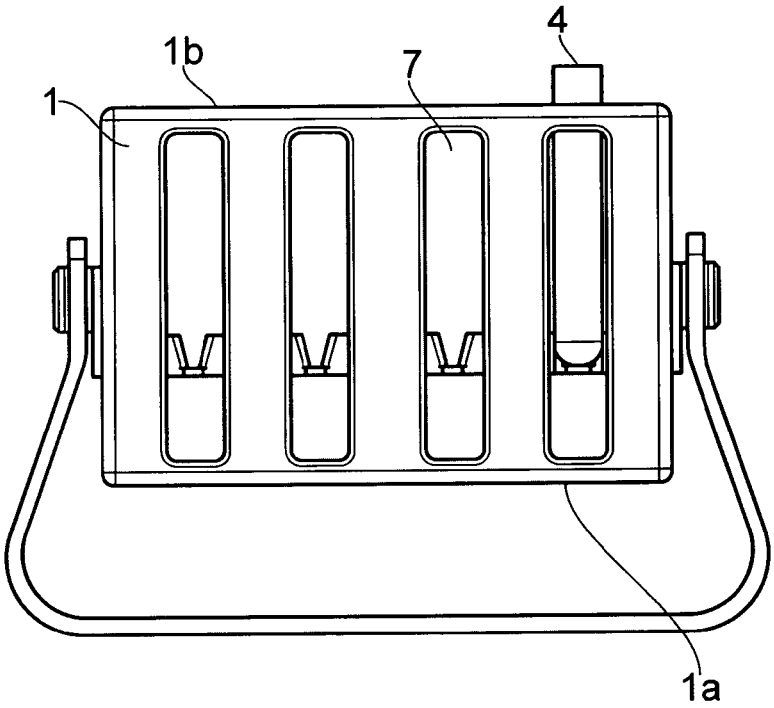
FIGS. 13*a*, 13*b* and 13*c* are a side-view, plan-view and perspective view of the magnetic separation rack according to the sixth embodiment of the disclosure when adapted to retain smaller sample vessels.
Figure 13B:
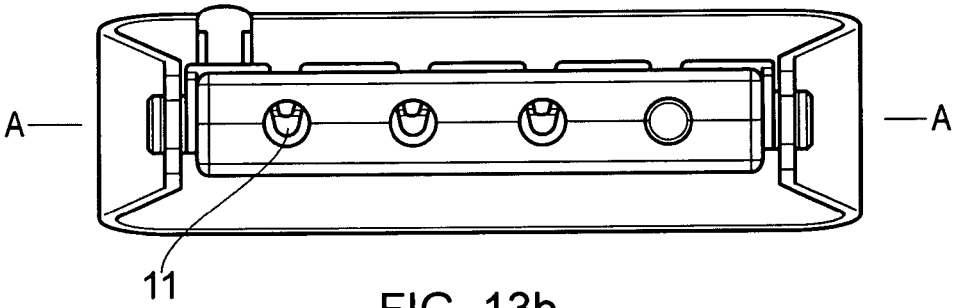
Figure 13C:
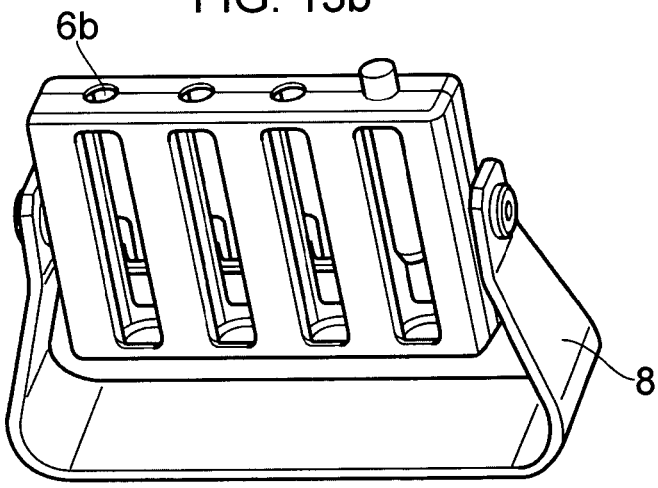

In FIGS. 13*a-c* the same magnetic separation device is arranged to receive and retain sample vessels of a second different predetermined size, e.g. "flow" test-tubes such as flow cytometry tubes available from B.D. Falcon, New Jersey. U.S.A. These particular sample vessels are smaller in size, i.e. thinner and shorter, than the sample vessels of the first predetermined size. The sample vessels of the second predetermined size are mountable within the sample vessel retaining portions (2) via the second apertures (6*b*) that are formed on the lower surface (1*b*) of the body portion (1). Hence, the body portion (1) is rotated by approximately 180° with respect to the foot portion (8) such that the second apertures (6*b*) formed in the lower surface (1*b*) of the body portion (1) are arranged upper side. The sample vessels of the second predetermined size are substantially shorter than the passage of the sample vessel retaining portion. Therefore, the sample vessel supporting member (10) is required to support the tip of the sample vessel within the passage (7). The sample vessel supporting member (10) is pivoted to the second position such that a supporting portion (11) of the member extends substantially across the width of each passage. Thus, when the sample vessels of a second predetermined size are mounted in the sample vessel retaining portions the tips of the sample vessels are supported and the sample vessel is suitably retained.

A skilled person will appreciate that it will not be necessary to orientate the body portion by rotating the body portion or pivoting it around axis A if the first and second sample vessels have the same width but different lengths.

The magnetic separation rack may comprise an aperture defining element (12) to further define the predetermined width of a sample vessel (4) that may be received and retained in each sample vessel retaining portion (2). The aperture defining element comprises a plurality of aperture defining portions. Each aperture defining portion comprises a plurality of aperture segments of different predetermined widths. For example, the aperture defining element (12) depicted in FIGS. 7*a-c* and 8 comprises four aperture defining portions (12*a*, 12*b*, 12*c*, 12*d*) and each aperture defining portion comprises two aperture segments (13, 14) of two different predetermined widths. The first aperture segment (13) has a bigger predetermined width than the second aperture segment (14). Each aperture segment may be discrete or the aperture segments may be partially merged or overlapping, for example as illustrated in FIG. 7*a-c* and 8.

The aperture defining element (12) is preferably a frame or housing-like structure that is mountable around the body portion (1). The aperture defining element (12) comprises an upper surface (12*x*) and preferably a lower surface (12*y*). When the aperture defining element is mounted on the body portion (1) the upper surface (12*x*) of the aperture defining element (12) is arranged in juxtaposition with the upper surface (1*a*) of the body portion (1). Hence, the plurality of aperture defining portions (12*a-d*) formed in the upper surface (12*x*) of the aperture defining element (12) are arranged adjacent to the apertures of the sample vessel retaining portions (2) formed on the upper surface of the body portion (1).

The aperture defining element (12) and body portion (1) are relatively movable. For example, the frame or housing-like structure of the aperture defining element (12) may move, e.g. slide, relative to the body portion (1). Alternatively, the body portion (1) may move, e.g. slide, relative to the aperture defining element.

The aperture defining element (12) and body portion (1) are relatively movable between a plurality of user selectable positions. The number of user selectable positions will normally be equal to the number of aperture segments. In any given position, an aperture segment with a desired width is selected and aligned with respect to an aperture and passage of each sample vessel retaining portion. Hence, the selected aperture of the aperture defining element (12) determines the width of the sample vessel (4) that may be received and retained in the sample vessel retaining portion (2).

In the embodiment of the disclosure depicted in FIGS. 7*a-c* and 8 the body portion (1) is arranged such that it can slide horizontally along axis A relative to the aperture defining element (12). Since the aperture defining portions (12*a-d*) only have two aperture segments (13, 14), the body portion (1) is movable between one of two positions. In the first position, the first larger aperture segment (13) is aligned with respect to the sample vessel receiving portions on the body portion (1) and in the second position smaller aperture segment (14) is aligned with respect to the sample vessel receiving portions on the body portion (1). Hence, when the body portion (1) is moved to the first position then sample vessels (4) with a first predetermined width may be mounted within the rack. When the body portion (1) is moved to the second position then sample vessels (4) with a second predetermined width may be mounted in the rack.

In FIGS. 9*a* and 9*b* it can be seen that an embodiment of the disclosure may be configured such that the body portion (1) is movable between two positions such that the magnetising rack may retain wider "Falcon" test-tubes (when the body portion (1) is moved to the right relative to the aperture defining element 12)) and narrower "Flow" test-tubes (when the body portion (1) is moved to the left relative to the aperture defining element (12).

Similarly to FIGS. 9*a* and 9*b*, FIG. 10 depicts an embodiment of the disclosure whereby the body portion (1) is also movable with respect to an aperture defining element (12) such that "Falcon" test-tubes and "Flow" test-tubes may be mounted in the magnetic separating rack. However, in this particular embodiment, the frame-like structure of the aperture defining element is configured such that a lower surface (12*y*) acts as a foot portion such that the rack may stand on a supporting surface.

The particles to be isolated in a sample may be magnetically labeled using conventional labelling means. For example, the sample may be mixed with magnetic beads that bind to or coat the target particles of interest during a short incubation. The target substances may be, for example, DNA, RNA, mRNA, proteins, bacteria, viruses, cells, enzymes, pesticides, hormones or other chemical compounds.

In operation, a sample is initially incubated with magnetic labelling means such that the particles to be magnetically targeted are rosetted. After incubation, the magnetic separation rack is used to isolate the magnetically labeled particles from the non-magnetic medium. The sample vessel retaining portion is mounted on the magnetising portion such that the sample, contained within at least one sample vessel retained on the sample vessel retaining portion, is subject to a high-gradient magnetic field. The magnetically labeled particles are attracted by the magnetic field and consequently migrate to regions of the internal surface of the sample vessel adjacent the first and second magnetising portions (3*a*, 3*b*). This enables the easy removal of the non-magnetic supernatant, possibly using a pipette, whilst the magnetically labeled particles are left isolated in the sample vessel. After washing, the target particles may be used in further studies (positive particle isolation). Magnetic separation may also be used to remove unwanted magnetic particles from a suspension such that substances remaining in the supernatant that is now depleted of the target particles can be used (negative isolation).

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A magnetic separation rack for isolating magnetically labeled particles from a non-magnetic medium comprising a body portion having:

a linear array of sample vessel retaining portions;

each sample vessel retaining portion comprising at least one visible portion; and a plurality of magnetizing portions arranged within the body portion such that at least two magnetizing portions are circumferentially spaced about each sample vessel retaining portion and the at least two magnetizing portions are arranged on either side of each sample vessel retaining portion;

the plurality of magnetizing portions arranged in a parallel relation to each other;

each of the plurality of magnetizing portions comprising:

a first magnet and a second magnet that are arranged parallel to each other;

the first and the second magnets further arranged adjoining each other; and the first magnet and the second magnet having antiparallel magnetic pole arrangements with respect to each other;

wherein at least one magnet of the respective magnetizing portions are configured such that their pole orientations are diametrically directed relative to the sample vessel retaining portions in an attractive configuration and their poles are oriented substantially along the same axis; and a foot portion having:

a surface by which the body portion may stand on a supporting surface;

wherein the foot portion is pivotally coupled to the body portion such that the body portion is operatively tiltable with respect to the foot portion.

2. The magnetic separation rack according to claim 1 wherein the north and south poles of the first magnet and the second magnet of each of the plurality of magnetizing portions are arranged in an alternating sequence such that:

a first side of a first sample vessel placed in the array of sample vessel retaining portions faces the north pole of a first magnetizing part of the first magnet and faces the south pole of a second magnetizing part of the first magnet;

the opposite side of the first sample vessel faces the south pole of a first magnetizing part of the second magnet and faces the north pole of a second magnetizing part of the second magnet; and magnets of a subsequent magnetizing portion of the plurality of magnetizing portions are similarly arranged for a second and any subsequent sample vessel.

3. The magnetic separation rack according to claim 1 wherein each magnetizing portion comprises at least one magnet and wherein:

a magnet of a first magnetizing portion of the plurality of magnetizing portions is located on the directly opposite side of the first magnet of a second magnetizing portion, with a first sample vessel retaining portion located in between the magnet of the first magnetizing portion and the first magnet of the second magnetizing portion; and the magnet of the first magnetizing portion has antiparallel magnetic pole arrangement with respect to the first magnet of the second magnetizing portion; and wherein the second magnet of a second magnetizing portion of the plurality of magnetizing portions is located on the directly opposite side of the first magnet of a third magnetizing portion, with a second sample vessel retaining portion located in between the second magnet of the second magnetizing portion and the first magnet of the third magnetizing portion;

the second magnet of the second magnetizing portion has antiparallel magnetic pole arrangement with respect to the first magnet of the third magnetizing portion; and the arrangement of magnets and antiparallel pole arrangements of any subsequent magnetizing portions is repeated.

4. The magnetic separation rack according to claim 3 wherein the at least one magnet is configured within each magnetizing portion such that a main volume of a sample vessel mounted within each sample vessel retaining portion is subject to the magnetic field.

5. The magnetic separation rack according to claim 3 wherein the at least one magnet is configured within each magnetizing portion such that a tip of a sample vessel mounted within each sample vessel retaining portion is subject to the magnetic field.

6. The magnetic separation rack according to claim 3 wherein the at least one magnet in each magnetizing portion is configured such that a substantial portion of a sample vessel mounted within each sample vessel retaining portion is encompassed by magnetic material.

7. The magnetic separation rack according to claim 6 wherein the at least one magnet comprises a concave face that is shaped at least approximately to conform to a certain portion of the sample vessel.

8. The magnetic separation rack according to claim 1 wherein the at least one visible portion is an aperture or transparent portion.

9. The magnetic separation rack according to claim 8 wherein the at least one visible portion is a portion extending at least substantially along the length of the sample vessel retaining portion.

10. The magnetic separation rack according to claim 1 further comprising at least one light emitting diode to illuminate the at least visible portion of the sample vessel retaining portion.

11. The magnetic separation rack according claim 1 further comprising at least one magnifying member to magnify a predetermined area of the at least one visible portion of the sample vessel retaining portion.

12. The magnetic separation rack according to claim 1 wherein each sample vessel retaining portion comprises:

an aperture formed in an upper surface of the body portion; and a passage that extends at least substantially through the body portion from the aperture formed in the upper surface, wherein the aperture and passage are configured to receive and retain a sample vessel of a predetermined size.

13. The magnetic separation rack according to claim 1 wherein each sample vessel retaining portion comprises:

a first aperture formed in an upper surface of the body portion of a first predetermined width;

a second aperture formed in a lower surface of the body portion of a second predetermined width; and a passage extending through the body portion between the first aperture and the second aperture, wherein the first predetermined width of the first aperture is the same as or different to the second predetermined width of the second aperture.

14. The magnetic separation rack according to claim 13 whereby the first predetermined width of the first aperture is different to the second predetermined width of the second aperture and the foot portion is pivotally coupled to the body portion such that the body portion is operatively rotatable with respect to the foot between a first orientation and a second orientation, wherein:

in the first orientation, the body portion is orientated such that a sample vessel of a first predetermined width may be received and retained in each sample vessel retaining portion via the first apertures, and in the second orientation, the body portion is orientated such that a sample vessel of a second predetermined width may be received and retained in each sample vessel retaining portion via the second apertures.

15. The magnetic separation rack according to claim 14 further comprising a sample vessel supporting member having a supporting portion, the member being movable between a first position and second position, wherein:

in the first position, said portion of the sample vessel supporting member is located within the passage of each sample vessel retaining portion in a position effective to support a sample vessel, and in the second position, said portion of the sample vessel supporting member is located outside the passage of each sample vessel retaining portion.

16. The magnetic separation rack according to claim 1 further comprising an aperture defining element having a plurality of aperture defining portions wherein each aperture defining portion comprises a plurality of aperture segments of different predetermined sizes;

whereby, the aperture defining element and the body portion are relatively movable between a range of positions and at any given position a selected aperture segment from each aperture defining portion is aligned with each sample vessel retaining portion.

17. A method of isolating magnetically labeled particles from a non-magnetic medium using a magnetic separation rack, comprising the steps of:

(i) providing a magnetic separation rack comprising:

a body portion having:

an array of sample vessel retaining portions;

each sample vessel retaining portion comprising at least one visible portion:

a plurality of magnetizing portions arranged within the body portion such that at least two magnetizing portions are circumferentially spaced about each sample vessel retaining portion and the at least two magnetizing portions are arranged on either side of each sample vessel retaining portion;

the plurality of magnetizing portions arranged in a parallel relation to each other;

each of the plurality of magnetizing portions comprising:

a first magnet and a second magnet that are arranged parallel to each other;

the first and the second magnets further arranged adjoining each other; and the first magnet and the second magnet having antiparallel magnetic pole arrangements with respect to each other;

wherein at least one magnet of the respective magnetizing portions are configured such that their pole orientations are diametrically directed relative to the sample vessel retaining portions in an attractive configuration and their poles are oriented substantially along the same axis; and a foot portion having:

a surface by which the body portion may stand on a supporting surface, wherein the foot portion is pivotally coupled to the body portion such that the body portion is operatively tiltable with respect to the foot portion;

(ii) mounting at least one sample vessel in the sample vessel retaining portion;

(i) mounting a sample vessel retaining portion on a magnetizing portion;

(iii) subjecting a sample having magnetically labeled particles, contained in the at least one sample vessel retained in the sample vessel retaining portion, to the magnetic field of the magnetizing portion; and (iv) removing non-magnetic supernatant.

* * * * *